US005570123A

United States Patent [19]

Almonte

[11] Patent Number: 5,570,123

[45] Date of Patent: Oct. 29, 1996

[54] THERMAL PRINT HEAD WITH AUXILIARY PRINTER HEAD GUARD

[75] Inventor: Ralph Almonte, Cranston, R.I.

[73] Assignee: Comtec Information Systems, Inc., Warwick, R.I.

[21] Appl. No.: 497,116

[22] Filed: Jun. 30, 1995

[51] Int. Cl.[6] ..... B41J 2/335; B41J 2/34

[52] U.S. Cl. ..... 347/200

[58] Field of Search ..... 347/200, 201, 347/202, 203, 204, 205, 206, 207, 208, 209

[56] References Cited

U.S. PATENT DOCUMENTS 4,680,593 7/1987 Takeno et al. .
4,712,935 12/1987 LaDue et al. .
5,223,855 6/1993 Ota et al. .
5,245,356 9/1993 Ota et al. .
5,305,021 4/1994 Ota et al. .
5,329,298 7/1994 Hong et al. .

*Primary Examiner*—Huan H. Tran
*Attorney, Agent, or Firm*—M. Lukacher

[57] ABSTRACT

A thermal print head includes an auxiliary print head guard disposed in close relationship to the primary print head guard so as to protect from damage by a foreign object the material encapsulating the electrical components and connectors contained on an integrated circuit board.

9 Claims, 3 Drawing Sheets

FIG. 3
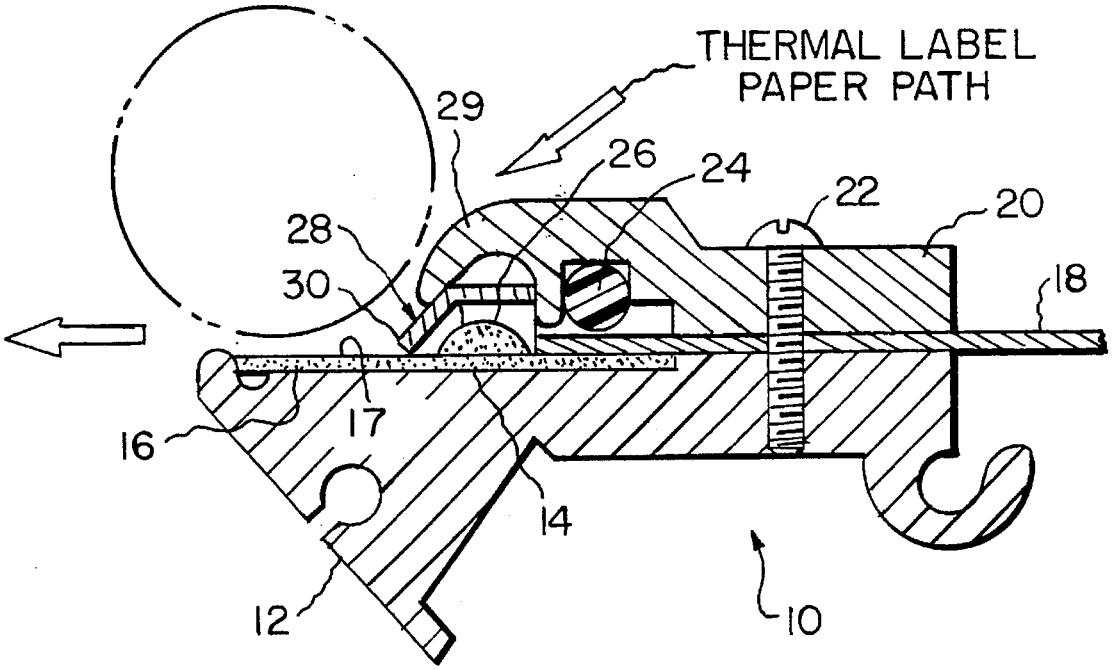
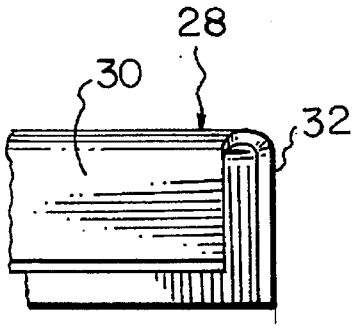
FIG. 5
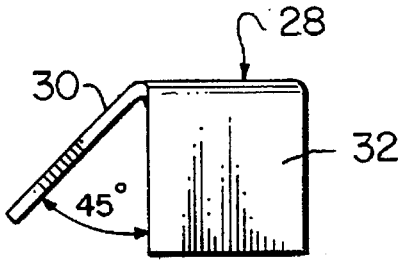
FIG. 4

THERMAL PRINT HEAD WITH AUXILIARY PRINTER HEAD GUARD

DESCRIPTION

This invention relates to thermal print heads and particularly to an improved thermal print head having an auxiliary guard member in protecting relationship with the internals of the head. A thermal print head embodying the invention uses the auxiliary guard or a secondary print head guard in addition to a primary or single print head guard conventionally found in thermal print heads.

The invention is especially suitable for use in protecting an integrated circuit (IC) of the print head which is encapsulated in a substrate such as of glass.

Thermal print heads (such as line-type print heads) are widely used to print graphics, text, bar-codes, etc. onto thermosensitive paper delivered from a supply, such as a roll of paper.

Generally, line-type thermal print heads (such as is illustrated in FIG. 1 - Prior Art) have a printed circuit board 1 which is mounted to a heat sink member 2. The printed circuit board (PCB) includes a plurality of longitudinally arranged wires presenting heating elements exposed as (dots) of a glass substrate(s). Drive ICs, integrated circuits or chips 4 are mounted on the board 1 and connected to the heating wires by wire connections 5 which may be encapsulated in a plastic covering 6. Other components and/or connectors to other circuits are mounted on the circuit board 1. A cover guard member 7 is attached to the head circuit board as by screws 8 so as to cover and protect part of the substrate and the ICs. The thermosensitive paper is pressed against the longitudinal array of heating dots as by a platen roller (9). As the thermosensitive paper passes between the platen and the heating dots, the paper changes color where heated to print text or graphics onto the thermosensitive paper. Thermal print heads of the type just described are used extensively for printing labels and other instances where similar printing is required. An example of one such typical thermal printer head is the LTP 3245-384 "thermal printer mechanism" sold by Seiko Instruments Inc.

Thermal print heads, however, can be easily and often damaged when consumers try to clean the print heads of foreign matter. Additionally, serious damage often occurs when the consumer tries to dislodge adhesive backed labels which become stuck or jammed in the print head. Generally, while attempting to clear the jammed adhesive backed paper from the print head, the consumer will insert a sharp, pointed foreign object, such as a paper clip, knife, etc. between the guard 7 and the glass substrate 3 and thereby puncture the material 6 encapsulating the integrated circuits. This is quite serious as any penetration of that material, no matter how slight, may prove sufficient to break the connectors 5 and virtually destroy the integrity of the thermal print head. Then the printer in which the head is installed must be returned to the manufacturer for replacement of the print head and realignment of the paper feed mechanism of the printer.

It is believed the root cause of the problem cited above is that the commonly used printer head guards cannot maintain a sufficiently uniform and small size gap over the internals of the printer head and, particularly next to the glass substrate, in order to prevent the uses from attempting potentially harmful in-the-field repairs. Existing thermal printer heads incorporate an overly spacious gap mainly because of the tolerance required to ensure that the printer head guard will not be forced against the glass substrate. If such an event were to occur, the substrate may be stressed sufficiently that it would crack. In all likelihood the printer then would be rendered inoperative.

Examples of prior art thermal print heads which utilize guards for protecting integrated circuits or parts of the head assembly are found in U.S. Pat. Nos. 4,712,935; 4,680,593; 5,223,855; 5,329,298; 5,305,021 and 5,245,356.

It is the principal object of the present invention to provide an improved thermal print head which cannot readily be damaged by intrusion of foreign articles into the integrated circuit/print area.

Briefly described, an improved thermal print head guard, in accordance with the presently preferred embodiment includes a secondary guard member used in conjunction with a primary guard to ensure that damage to the thermal print head does not occur. The secondary guard member is mounted in close juxtaposition to the primary guard member so as to closely cover and house the integrated circuits and the material encapsulating the IC's.

The foregoing, as well as other features, advantages and objects of the present invention will become more evident from reading the following description accompanying the attached drawings in which:

FIG. 3 is a sectional view taken along line 3—3 of FIG. 2 of an assembled thermal print head according to the invention;

FIG. 4 is an enlarged side view of the auxiliary guard of the present invention; and FIG. 5 is a partial front view of the guard shown in FIG. 4.

Figure 1:
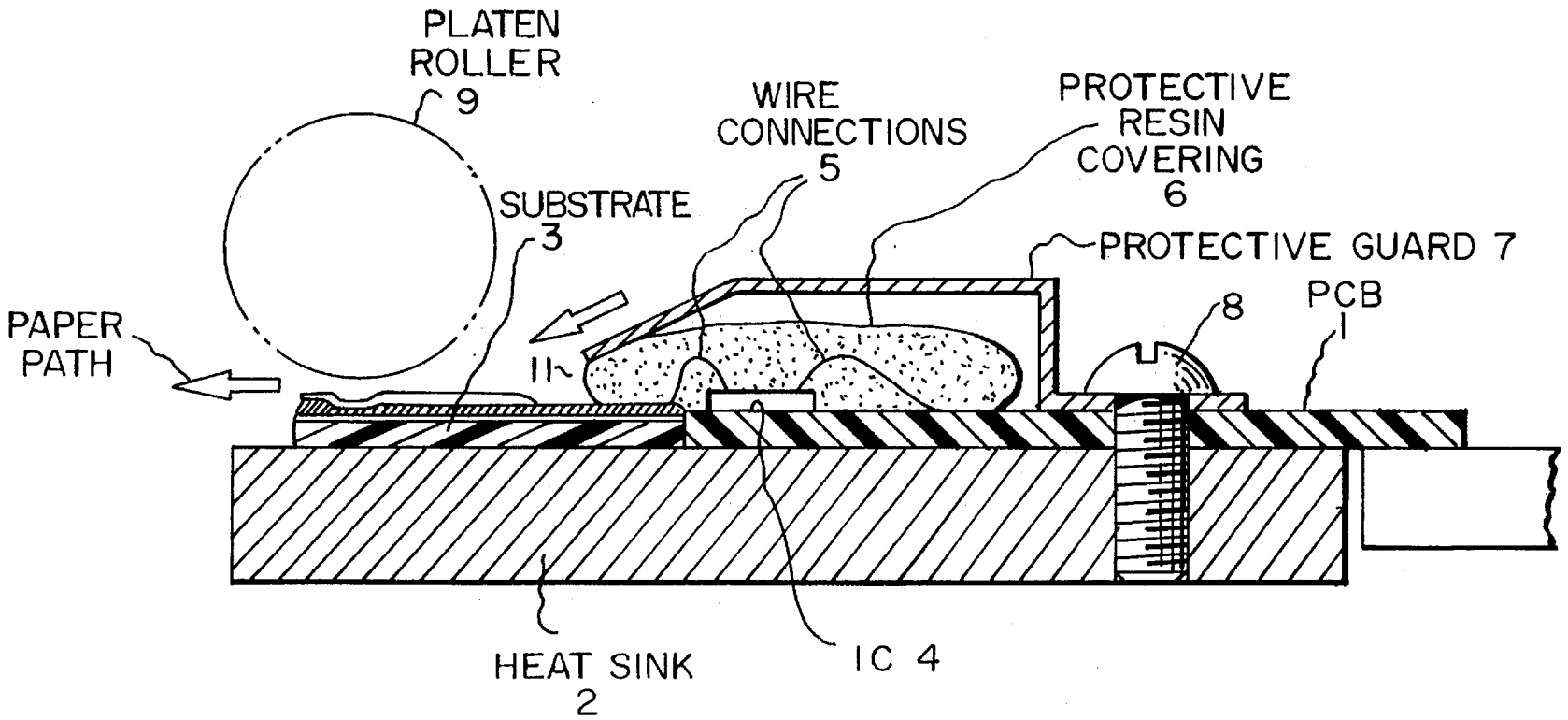
FIG. 1 (PRIOR ART)
FIG. 1 is a sectional view of a thermal print head commonly used in prior art devices.

Referring now to the drawings, and particularly to FIG. 1 - Prior Art, it is readily evident that a fairly significant aperture 11 is left between the front edge of the commonly included protective guard 7 and the PC wire connections 5 and the protective plastic resin 6 covering the PC connections. Accordingly, should a piece of label paper being fed through the print head area begin to delaminate which, in turn, causes the paper to jam, an operator using the equipment may attempt an in-the-field repair. By so doing, damage may be caused to the protective resin 6 covering the PC connectors and can break the connector wires 5 or damage the IC 4, any of which could damage the head render the head totally inoperative. The extent of the damage may prevent it from printing or be such that it is not cost effective to repair the head or even the printer in which it is contained.

Figure 2:
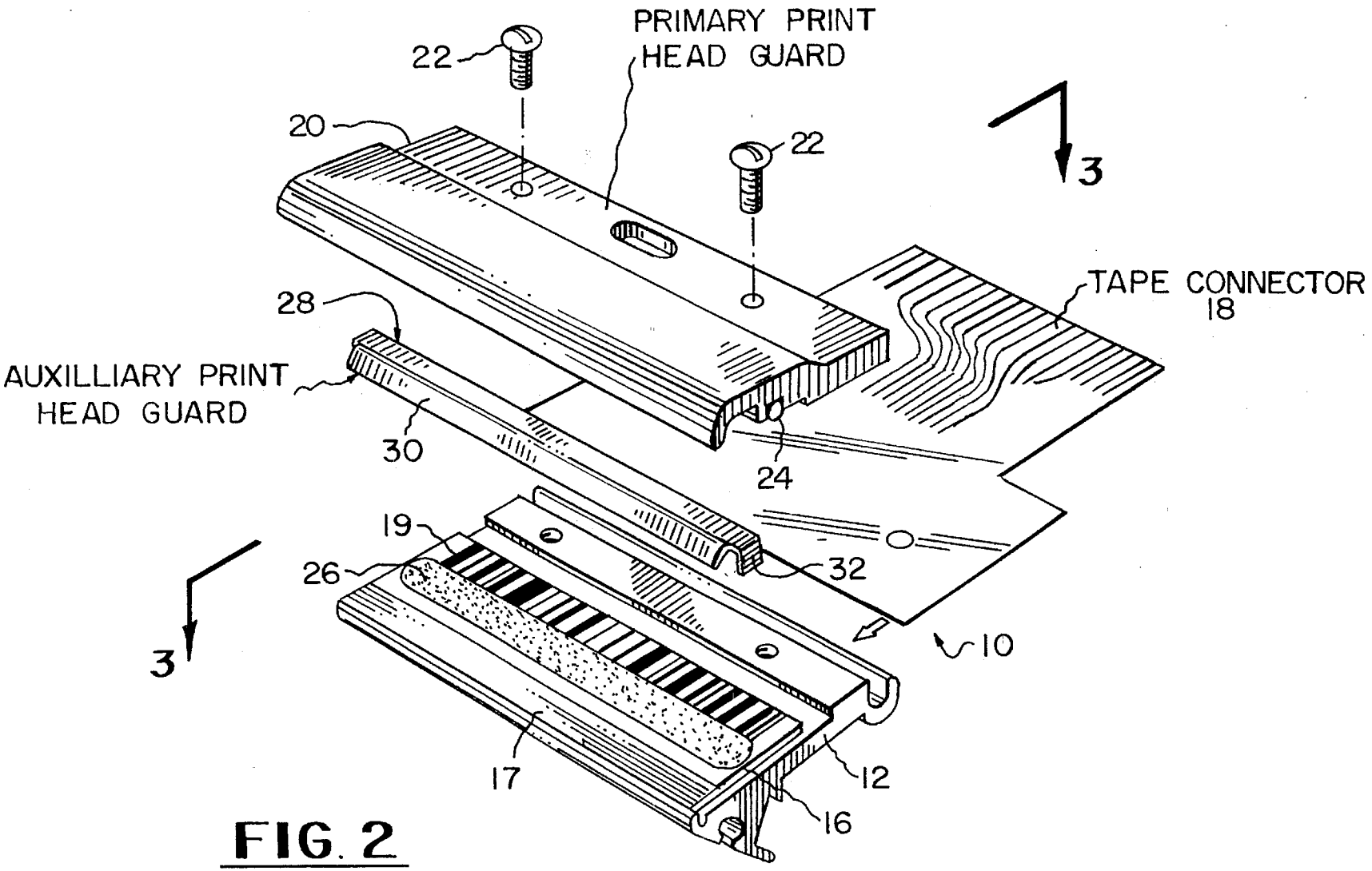
FIG. 2 is an exploded perspective view of a presently preferred embodiment of the invention.

Referring to FIGS. 2 and 3, there is shown a thermal print head 10 according to the invention. Thermal print head 10 is of conventional construction in its use of a heat sink member 12 to which a driving IC 14 is mounted on a substrate 16 and covered by encapsulating material 26. A multiplicity of heating elements (wires) extend from the IC 14 and present dots (not shown) which are exposed over a printing area 17 of the substrate 16. Electrical connections 19 between driving IC 14 and external circuits extend along the substrate 16 from the IC 14 and are joined to a tape or flexible PC board connector 18.

The flexible PC board 18 overlays substrate 16, as best seen in FIG. 3, and is held in place by a cover member 20 which is secured to heat sink 12 by way of screws 22. An elastic member 24 (a rubber rod) is utilized to press against PC board connector 18 to ensure that a firm and positive connection is thereby made between connector 18 and the connections 19 formed in substrate 16. As can be seen, cover member 20 acts to form a primary guard over the material 26, encapsulating and protecting the various IC pathways connected to the numerous heating wires.

Referring to FIGS. 2 and 3 and also to FIGS. 4 & 5, an auxiliary guard member 28 is mounted between cover member 20 and over the IC 14 and the material 26 encapsulating the IC and the pathways (connections 19) and any other components in the vicinity of the IC 14. Auxiliary guard 28 forms on enclosure for the IC and the fragile components and connections thereto. The guard 28 is constructed from an elongate strip of a rigid and fairly inflexible material, such as steel (e.g. 302 stainless steel sheet about 0.010 inch thick). The front or lip portion 30 (the end toward the platen roller) of auxiliary guard 28 is bent at an angle of approximately 45 degrees, although it is apparent that other angles, which may be either more or less acute, may be desirable. Additionally, side tabs 32 are bent at an angle of approximately 90 degrees at each side of auxiliary guard 28. However, angles other than 90 degrees may be utilized.

Side tabs 32 are constructed such that when auxiliary guard 28 is assembled in place, as is best illustrated in FIG. 3, they straddle substrate 16 and encapsulating material 26 so as to rest on heat sink 12, while angled front portion 30 extends over and above encapsulating material 26. The edge of the lip 30 of the auxiliary guard 28 contacts the substrate.

The primary guard has a nose or hook flange portion 29 which bears against the lip 30 and captures the auxiliary guard 28 without the need for any other mechanical fixture means.

Accordingly, as there is no space existing between auxiliary guard 28 and the fragile electrical connectors and the IC 14 and encapsulating material 26, it is highly unlikely that a foreign object could be introduced which could cause damage to these components and thereby damage or disable the print head.

From the foregoing description, it will be apparent that an improved print head having an auxiliary guard has been provided for thermal head printers to provide protection against accidental damage to the fragile electrical components of the printer head. Variations and modifications to the print head and its auxiliary guard, within the scope of the invention will undoubtedly suggest themselves to those skilled in the art. Therefore, the preceding description should be taken as illustrative and not in a limiting sense.

What is claimed is:

1. In a thermal print head having fragile components and including an integrated circuit and connections thereto, said fragile components, integrated circuit and connections being mounted on a substrate which is mounted on a support sink, and wherein said fragile electrical components and connections are protected by a primary guard disposed over the integrated circuit, said primary guard partially covering the substrate leaving an opening exposing said fragile components and connections to said integrated circuit, the improvement comprising an auxiliary guard disposed between said primary guard and said integrated circuit covering said integrated circuit and said fragile electrical components and connections, said auxiliary guard having a lip and sides defining an enclosure for said integrated circuit and the fragile components and connections thereto, said lip and sides having edges, said auxiliary guard having at least one of its said edges which faces said opening in contact with said substrate to prevent foreign objects from being introduced into said enclosure thereby preventing potential damage to said electrical components and connections.

2. The invention as set forth in claim 1 wherein said auxiliary guard extends laterally along said opening left by said primary guard, and said lip is an angled portion facing said opening, said angled portion extending downwardly toward said substrate to define said one of said edges.

3. The invention as set forth in claim 2 and further including side tabs forming opposite sides of said auxiliary guard, said tabs locate and support said auxiliary guard on the support sink.

4. The invention as set forth in claim 2 wherein said angled portion of said auxiliary guard is approximately 45 degrees to said substrate.

5. The invention as set forth in claim 3 wherein said side tabs form an angle of approximately 90 degrees to said substrate.

6. The invention as set forth in claim 1 wherein, said auxiliary guard has a top wall facing said primary guard and an open bottom facing said substrate.

7. The invention as set forth in claim 1 wherein said auxiliary guard is a unitary structure of rigid sheet material.

8. The invention according to claim 7 wherein said sheet material is steel.

9. The invention as set forth in claim 1 wherein said primary guard has a hook flange which bears against said primary guard and captures said auxiliary guard therein and on said substrate.

* * * * *